US009273423B2

(12) United States Patent
Chen

(10) Patent No.: US 9,273,423 B2
(45) Date of Patent: Mar. 1, 2016

(54) THREAD ROUTING MECHANISM FOR NEEDLE-SWITCHABLE TYPE SEWING MACHINE

(71) Applicant: CHEE SIANG INDUSTRIAL CO., LTD., New Taipei (TW)

(72) Inventor: Man Chuing Chen, New Taipei (TW)

(73) Assignee: CHEE SIANG INDUSTRIAL CO., LTD., New Taipei (TW)

( * ) Notice: Subject to any disclaimer, the term of this patent is extended or adjusted under 35 U.S.C. 154(b) by 194 days.

(21) Appl. No.: 14/178,862

(22) Filed: Feb. 12, 2014

(65) Prior Publication Data

US 2014/0345509 A1 Nov. 27, 2014

(30) Foreign Application Priority Data

May 24, 2013 (TW) ..... 102118356 A

(51) Int. Cl.
*D05B 49/00* (2006.01)
*D05B 55/00* (2006.01)
*D05B 51/00* (2006.01)

(52) U.S. Cl.
CPC ..... *D05B 49/00* (2013.01); *D05B 51/00* (2013.01); *D05B 55/00* (2013.01)

(58) Field of Classification Search
CPC ..... D05B 51/00; D05B 49/00; D05B 55/10; D05C 11/08; D05C 11/10
USPC ..... 112/302, 227, 163, 167, 80.4, 80.45, 112/241, 80.7
See application file for complete search history.

(56) References Cited

U.S. PATENT DOCUMENTS 1,822,765 A * 9/1931 Dickey ..... D05B 51/00 112/302
3,067,704 A * 12/1962 Pedersen ..... D05B 87/02 112/225
3,118,403 A * 1/1964 Pedersen ..... D05C 15/34 112/221
4,010,702 A * 3/1977 Miyamoto ..... D05B 87/00 112/225
4,023,512 A * 5/1977 Miyamoto ..... D05B 87/00 112/225
4,075,958 A * 2/1978 Sacchetti ..... D05B 51/00 112/163
4,325,314 A * 4/1982 Niem ..... D05B 51/00 112/199
5,347,942 A * 9/1994 Thomas ..... B65H 49/16 112/302
5,390,613 A * 2/1995 Shibata ..... D05C 11/16 112/163
5,682,830 A * 11/1997 Katou ..... D05B 87/02 112/225
5,881,660 A * 3/1999 Hiramatsu ..... B65H 69/00 112/302
6,325,006 B1 * 12/2001 Park ..... D05B 87/02 112/241
8,919,268 B2 * 12/2014 Chen ..... D05C 11/06 112/163
2014/0345509 A1 * 11/2014 Chen ..... D05B 51/00 112/242

* cited by examiner

*Primary Examiner* — Danny Worrell
(74) *Attorney, Agent, or Firm* — Rabin & Berdo, P.C.

(57) ABSTRACT

A thread routing mechanism for needle-switchable type sewing machine is installed on a needle bar switching mechanism of the sewing machine, and includes a thread take-up lever, a cylindrical needle bar case and a plurality of threads. The thread take-up lever includes a sway control end and a thread take-up end having thread holes. The cylindrical needle bar case has a rotation axis and a plurality of spaced needle bar holes, and internally defines a hollow space. The needle bar holes are equally distant from the rotation axis, and each receives a needle bar therein. The needle bars respectively carry a needle having an eye formed thereon. The threads are separately routed through a thread course defined by the thread holes, the hollow space and the needle eyes, such that the length of the threads in the thread course maintains same without being affected by a needle bar switching operation.

10 Claims, 16 Drawing Sheets

THREAD ROUTING MECHANISM FOR NEEDLE-SWITCHABLE TYPE SEWING MACHINE

FIELD OF THE INVENTION

The present invention relates to a thread routing mechanism located on a sewing head of a sewing machine for stabilizing the positions of multiple threads, and more particularly to a thread routing mechanism that defines a thread course and keeps multiple threads in the thread course in the same length when multiple needle bars on a sewing machine are switched from one to another.

BACKGROUND OF THE INVENTION

Generally, a sewing machine must include an upper horizontal arm, a lower machine bed and a needle plate. An arm shaft in the upper horizontal arm actuates a thread take-up mechanism and a crank unit synchronously, so as to drive a needle bar mechanism at a sewing head to move upward and downward. A fabric feeding mechanism is provided on the lower machine bed, and a loop taker is provided below the needle plate. In a sewing operation, a needle carried by the needle bar mechanism is driven to move upward and downward reciprocatingly to pierce through the fabric, so that a thread extended through an eye of the needle is also brought to downward extend through the fabric; meanwhile, the thread take-up mechanism and the loop taker are coordinately moved in correct time sequence to take up and release the thread.

The thread take-up mechanism is normally arranged above the needle bar mechanism to ensure proper tension of the thread and minimize a resistance to the thread when the same passes through the thread take-up mechanism. In the market, except some multi-needle bar embroiders, there are few sewing machines that allow direct switching of the needle bars thereof. Since the multi-needle bar embroiders generally have the drawbacks of having a bulky volume and requiring an extended travel distance for a fabric feeding surface on a driving unit, it is necessary to develop a sewing machine that allows direct switching of multiple needle bars from one to another according to actual need in the sewing operation while the sewing reference point and the needle plate for those needle bars are unchanged.

However, once the sewing machine adopts a cylindrical needle bar case on the sewing head to enable needle bar switching operation, the thread take-up mechanism must also be able to handle multiple threads. In this case, if the thread routing were not well controlled, the length of the threads in the thread course can not maintain same after the needle bar switching operation, resulting in change of the tension of the threads to adversely affect the subsequent sewing operation.

SUMMARY OF THE INVENTION

A primary object of the present invention is to provide a thread routing mechanism, which is installed on a sewing machine having switchable needle bars to define a stable thread course for multiple threads, so that the threads respectively routed through the thread course defined between multiple thread holes on a thread take-up lever and eyes on multiple needles can maintain the same length even after a needle bar switching operation on the sewing machine.

Another object of the present invention is to provide the above thread routing mechanism that further includes a thread pinching design provided between the thread holes of the thread take-up lever and the eyes of the needles. When the sewing machine is performing a sewing operation, the thread pinching unit can release the thread to be used while pinching the threads that are not in use, lest the unused threads should move out of the needle eyes.

A further object of the present invention is to provide the above thread routing mechanism that can further include one or more thread guides for use with the thread take-up lever, so that the thread take-up lever is not necessarily to locate immediately above the needle bars, making it more convenient in designing the overall structural arrangement of the sewing machine.

To achieve the above and other objects, the thread routing mechanism for needle-switchable type sewing machine according to the present invention includes a thread take-up lever, a cylindrical needle bar case, and a plurality of threads. The thread take-up lever includes a sway control end and a thread take-up end. The sway control end brings the thread take-up end to move upward and downward, and the thread take-up end is provided with a plurality of thread holes. The cylindrical needle bar case has a rotation axis and a plurality of spaced needle bar holes, and internally defining a hollow space extended from a top to a bottom of the cylindrical needle bar case. The needle bar holes is equally distant from the rotation axis, and each of the needle bar holes has a needle bar received therein, and the needle bars respectively carry a needle having an eye formed thereon. The threads are separately routed through a thread course defined by the thread holes on the thread take-up lever, the hollow space in the cylindrical needle bar case, and the eyes on the needles.

In a preferred embodiment of the present invention, a locating disc is provided on the bottom of the cylindrical needle bar case. The locating disc is provided at positions around the rotation axis with a plurality of thread guide holes, through which the threads are separately extended. And, a thread pinching unit is further mounted to an underside of the locating disc.

The thread pinching unit includes a pinching member mounted to the underside of the locating disc at a position corresponding to the thread guide holes. The pinching member includes a thread pinching surface for covering the thread guide holes, and the thread pinching surface is provided on an outer edge thereof with a notch, which is aligned with one of the thread guide holes.

In an operable embodiment, the thread pinching unit further includes a shaft member, a spring and a nut, which work with the pinching member to together form a means of pinching the threads. In addition, the thread pinching unit may also include a driving lever for working with the pinching member to together form a means of releasing the threads.

In another embodiment of the present invention, a thread pinching mechanism is directly provided between the thread take-up lever and the cylindrical needle bar case. The thread pinching mechanism includes a thread pressing disc unit consisting of a plurality of parallelly arranged pressing discs, a thread releasing unit located at one side of the pressing discs, and a driving unit for pushing the thread releasing unit to move. The thread releasing unit includes a pivot shaft and a plurality of parallelly arranged thread releasing plates. The thread releasing plates are respectively pivotally turnably connected at one end to the pivot shaft and are located in a staggered relation with respect to the pressing discs. The driving unit pushes a selected one of the thread releasing plates into a position between two adjacent pressing discs for releasing the thread pinched in between the two pressing discs.

In an operable embodiment, the driving unit includes a gearwheel and a movable member. The gearwheel is mounted about the rotation axis. The movable member has one side formed into a rack for meshing with the gearwheel, and another opposite side formed with a protruded rib. In another operable embodiment, the driving unit includes a plurality of air cylinders for respectively pressing against one thread releasing plate, and a plurality of restoring springs fitted around the pivot shaft in one-to-one correspondence with the thread releasing plates to restore the non-actuated air cylinders to their original positions.

It is understood the driving units according to the above two operable embodiments are only illustrative and not intended to limit the structure of the driving unit in any way. That is, any other different structural designs that can equivalently achieve the function of releasing a selected thread from the thread pressing discs are also included in the technical means of the present invention.

Further, a locating disc can be further mounted to the top of the cylindrical needle bar case. The locating disc is provided at a position near or closely around the rotation axis with one or more thread guide holes, through which the threads are extended.

In a preferred embodiment, one or more thread guides can be further provided in the thread course between the thread holes of the thread take-up lever and the hollow space in the cylindrical needle bar case for maintaining the threads in tension while changing the course of the threads.

The present invention is characterized in that the threads having been routed through the thread course defined by the thread holes on the thread take-up lever, the hollow space in the cylindrical needle bar case and the eyes on the needles are substantially equally spaced. With this arrangement, the length of the threads in the thread course would not change due to any needle bar switching operation on the sewing machine. The present invention is also characterized in that a thread pinching design can be further provided between the thread holes of the thread take-up lever and the eyes of the needles for pinching the threads that are not to be used in a sewing operation after a needle bar switching operation, lest the unused threads should separate from the needle eyes.

In the embodiment that includes one or more thread guides in the thread course between the thread take-up lever and the cylindrical needle bar case, the thread take-up lever is not necessarily to locate immediately above the needle bars, making it more convenient in designing the overall structural arrangement of the sewing machine.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
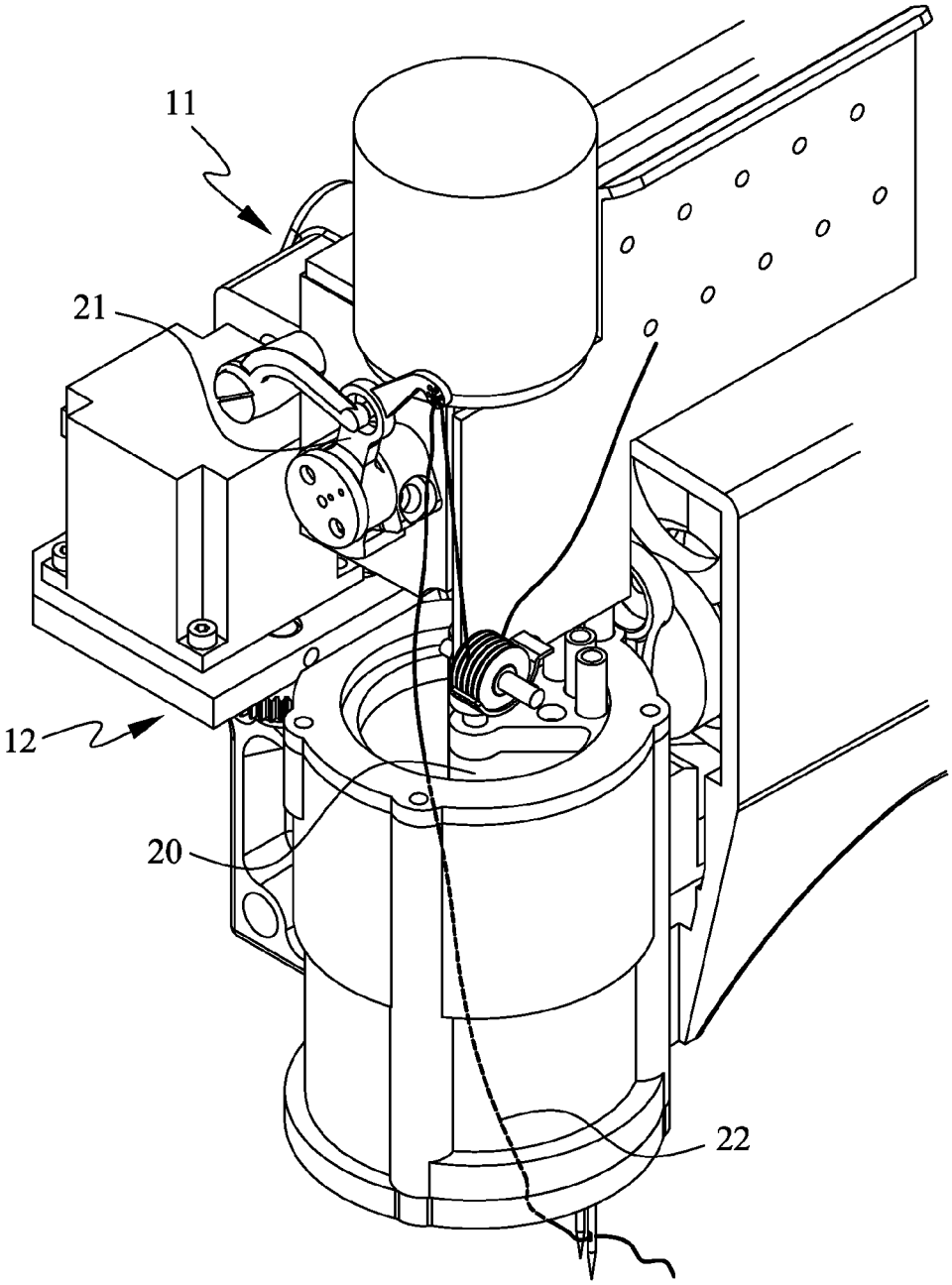
FIG. 1 is a perspective view showing a thread routing mechanism according to a preferred embodiment of the present invention is provided on a sewing head of a sewing machine.

The present invention will now be described with some preferred embodiments thereof and with reference to the accompanying drawings. For the purpose of easy to understand, elements that are the same in the preferred embodiments are denoted by the same reference numerals.

Please refer to FIG. 1. A thread routing mechanism for needle-switchable type sewing machine according to the present invention is installed on a needle bar switching mechanism 12 located at a sewing head 11 of a sewing machine 10. The thread routing mechanism according to the present invention mainly includes a cylindrical needle bar case 20 and a thread take-up lever 21, which together define a thread course, along which a plurality of threads 22 is routed at the same time.

Figure 2:
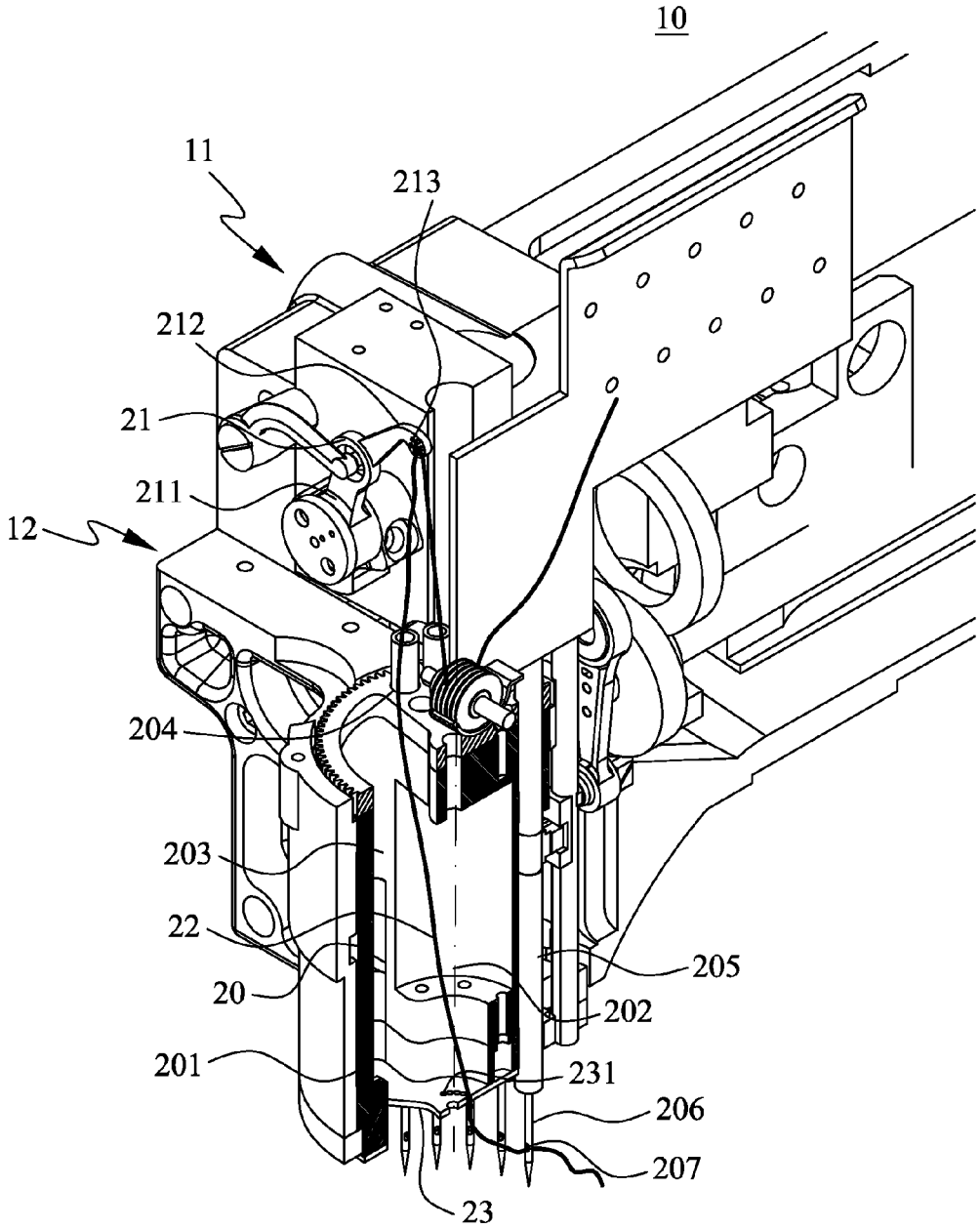
FIG. 2 is a partially cutaway view of FIG. 1 showing the structure of a cylindrical needle bar case included in the threading routing mechanism of the present invention.

As can be seen from FIG. 2, the cylindrical needle bar case 20 includes a cylindrical wall 201 internally defining a hollow space 203 extended from a top to a bottom of the cylindrical needle bar case 20, and a center of the hollow space 203 defines a rotation axis 202. A plurality of needle bar holes 204 is spaced near a peripheral edge of the top of the cylindrical needle bar case 20. The needle bar holes 204 are equally distant from the rotation axis 202. Each of the needle bar holes 204 has a needle bar 205 received therein, and the needle bars 205 respectively carry a needle 206 having an eye 207 formed thereon. The cylindrical needle bar case 20 can be driven by the aforesaid needle bar switching mechanism 12 to rotate, so that one of the needle bars 205 on the cylindrical needle bar case 20 is selected and switched to a sewing position.

The thread take-up lever 21 is pivotally movably mounted to a front end of the sewing head 11 of the sewing machine 10 to locate immediately above the cylindrical wall 201 of the cylindrical needle bar case 20. The thread take-up lever 21 includes a sway control end 211 and a thread take-up end 212. The sway control end 211 is pivotally turnable to move the thread take-up end 212 upward and downward. The thread take-up end 212 is provided with a plurality of thread holes 213, through each of which a thread 22 is extended.

The threads 22 are routed through a thread course defined by the thread holes 213 on the thread take-up lever 21, the hollow space 203 in the cylindrical needle bar case 20 and the eyes 207 on the needles 206. In this way, the length of the threads 22 would not change after the needle bars 205 are switched from one to another on the sewing machine 10.

In an operable embodiment of the present invention, the thread routing mechanism further includes a locating disc 23 provided on the bottom of the cylindrical needle bar case 20. The locating disc 23 rotates synchronously with the cylindrical needle bar case 20, and is provided closely around the rotation axis 202 with a plurality of circumferentially spaced thread guide holes 231, through which the threads 22 are extended to stabilize the thread course. Further, a plurality of openings 232 (see FIG. 6) is provided on the locating disc 23 at positions corresponding to the spaced needle bar holes 204.

Figure 3:
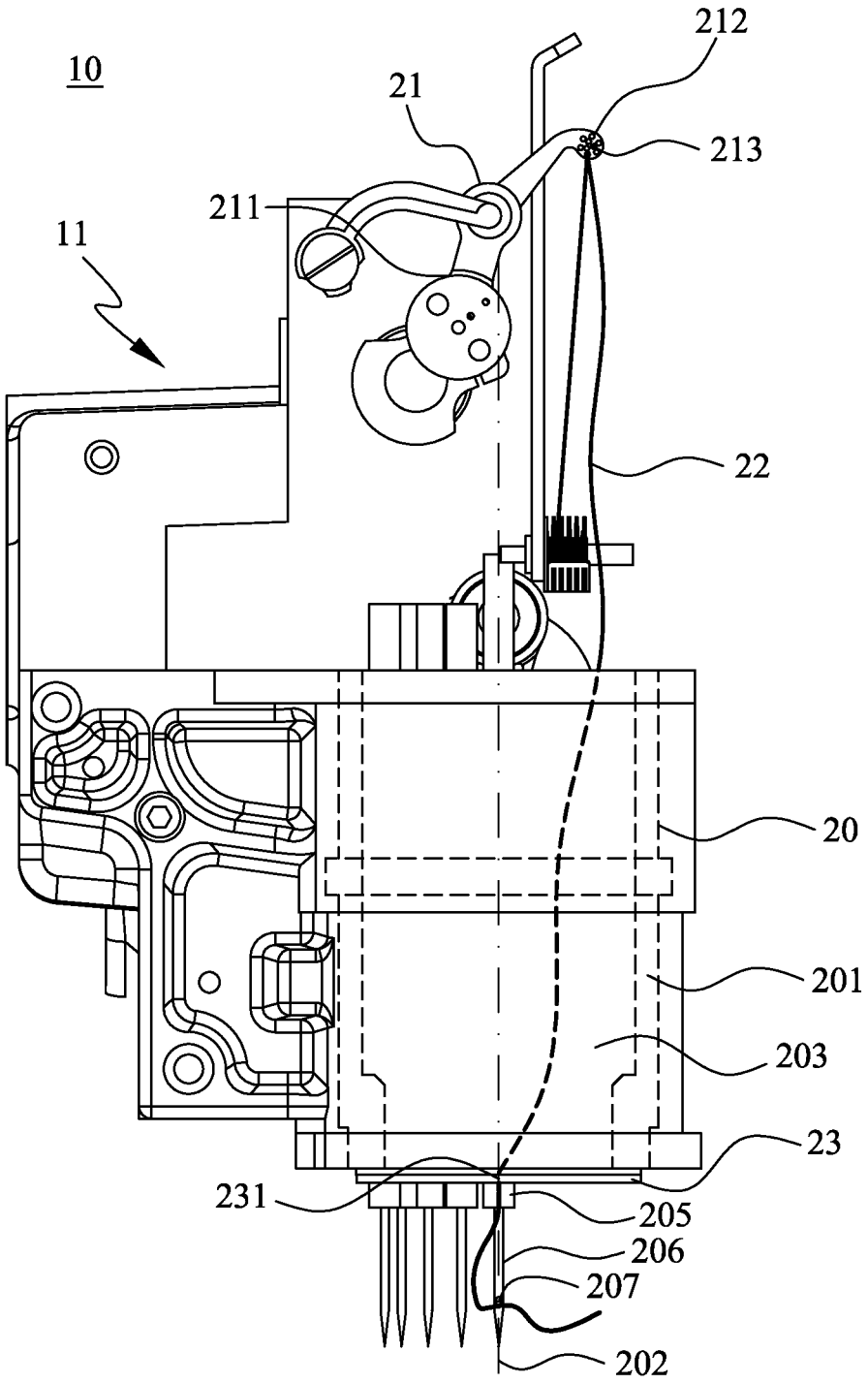
FIG. 3 shows the cylindrical needle bar case is provided on a bottom with a locating disk, on which one single thread guide hole is formed.

However, the above-described locating disc 23 is only illustrative to facilitate explanation of the present invention. That is, the locating disc 23 is not necessarily provided with a plurality of thread guide holes 231. As shown in FIG. 3, the locating disc 23 can have only one thread guide hole 231 provided thereon for the threads 22 to extend therethrough.

Figure 4:
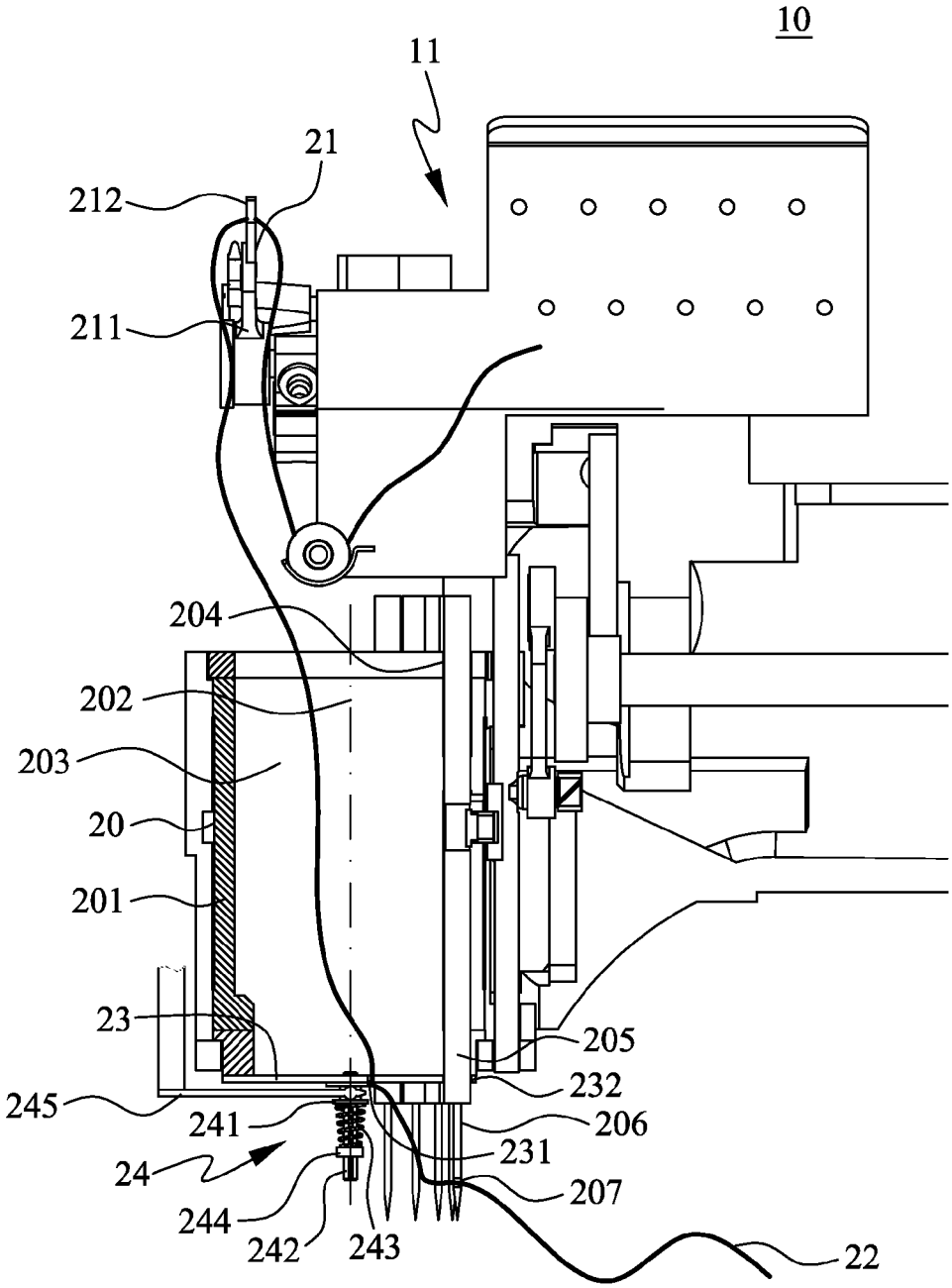
FIG. 4 is a sectional view showing a thread pinching unit is provided below the locating disc at the bottom of the cylindrical needle bar case.

Please refer to FIG. 4. A thread pinching unit 24 can be further mounted to an underside of the locating disc 23 for releasing a selected one of the threads 22, which have extended through the thread guide holes 231, during a needle bar switching operation, or pinching the threads 22 when a sewing operation starts.

Figure 5:
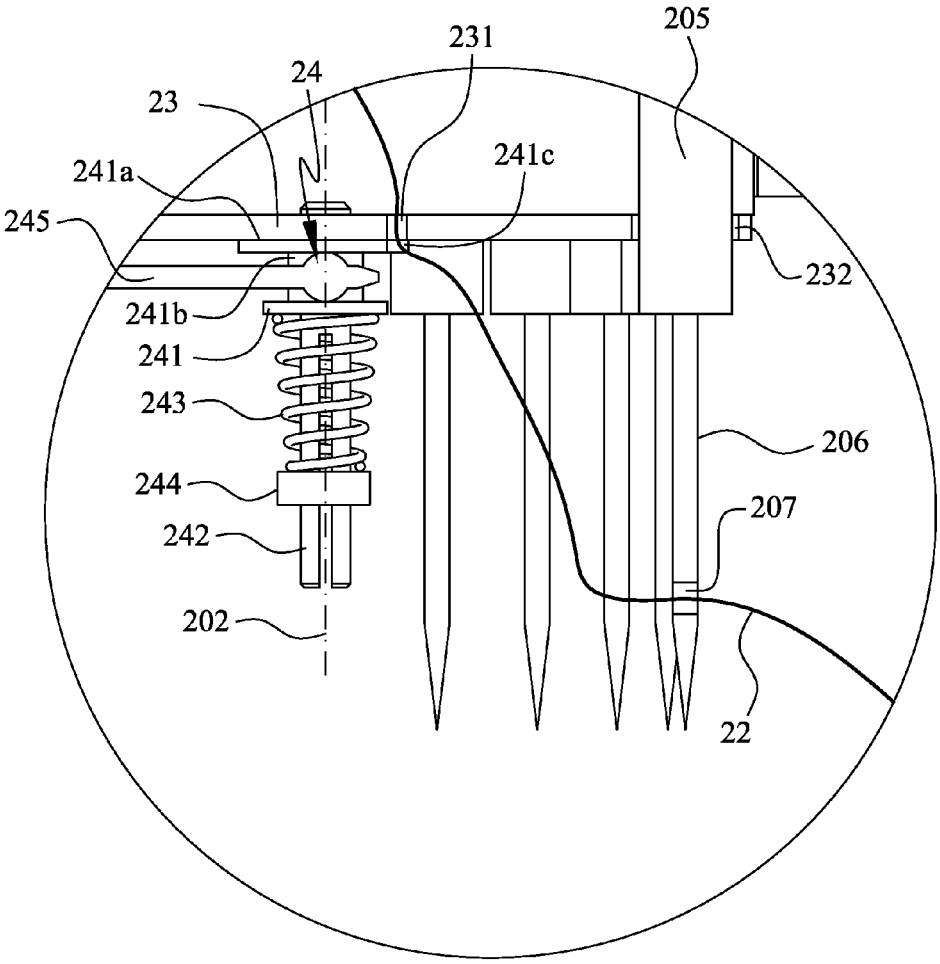
FIG. 5 is an enlarged view of FIG. 4 showing a thread is routed through the locating disc, the thread pinching unit and a needle bar.

As can be seen from FIG. 5, the thread pinching unit 24 includes a pinching member 241 for pinching the threads 22; a shaft member 242 axially extended through the pinching member 241; a spring 243 fitted around the shaft member 242; a nut 244 tightened to a lower end of the shaft member 242; and a driving lever 245 having an end engaged with the pinching member 241. The spring 243 has a lower end pressed against the nut 244 and an upper end pressed against the pinching member 241, so that the pinching member 241 is normally pushed by the spring 243 to tightly contact with the underside of the locating disk 23 to form a means of pinching the threads. The driving lever 245 is used to drive the pinching member 241 downward against the spring force of the spring 243 and accordingly separate the pinching member 241 from the underside of the locating disk 23 to form a means of releasing the threads 22. In this manner, the threads 22 can be released when the needle bars 205 are to be switched from one to another.

Figure 6:
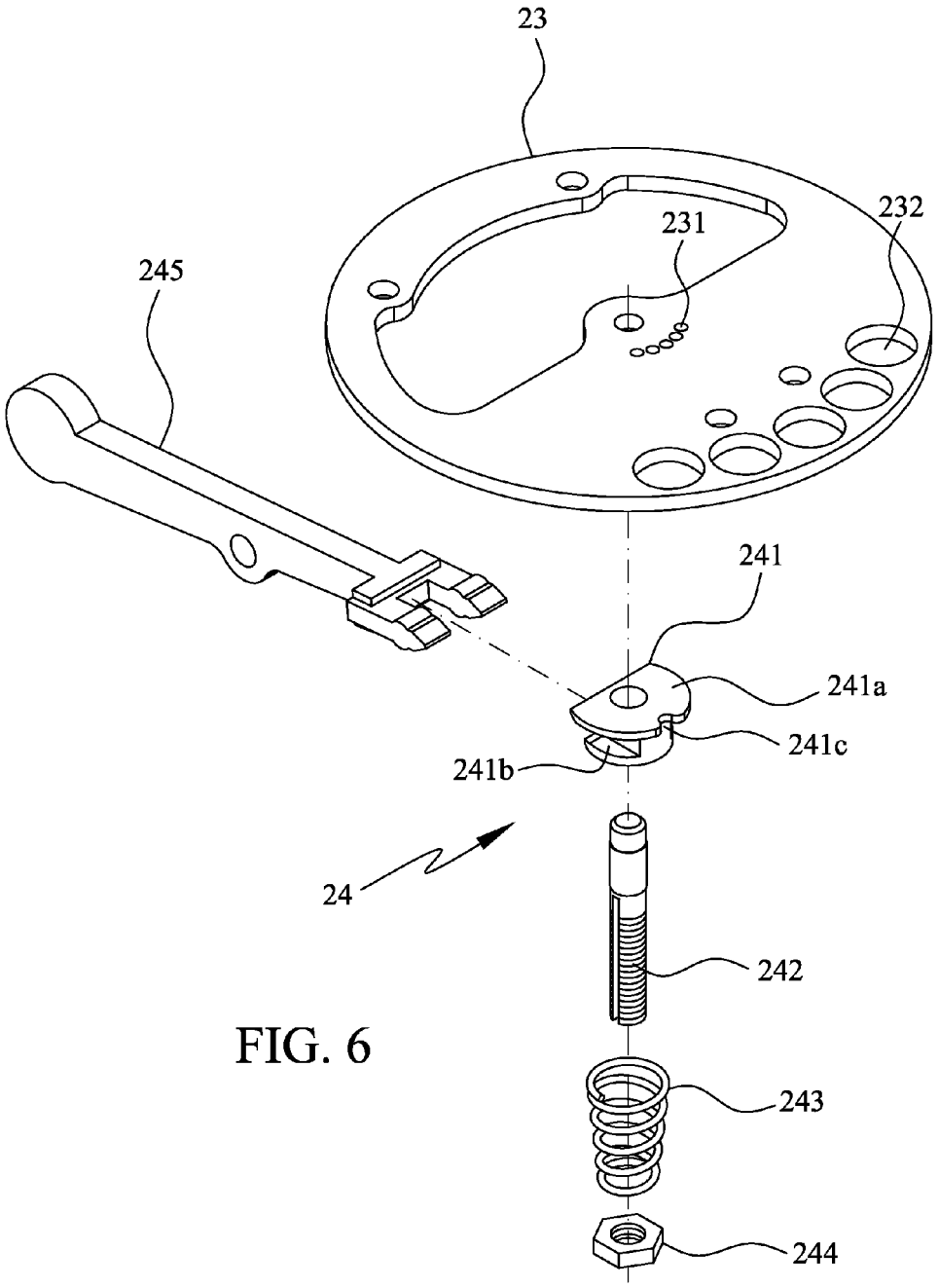
FIG. 6 is an exploded perspective view showing the locating disc and the thread pinching unit.

As can be seen from FIG. 6, the pinching member 241 includes a thread pinching surface 241*a*, which covers the thread guide holes 231; and an engaging section 241*b*, which is downward extended from the thread pinching surface 241*a* for engaging with the driving lever 245 to prevent the whole pinching member 241 from rotating about the rotation axis 202. The thread pinching surface 241*a* is provided on an outer edge thereof with a notch 241*c*, which is aligned with one of the thread guide holes 231 for allowing one of the threads 22 that is currently in use to freely pass therethrough, while all other thread guide holes 231 that are not aligned with the notch 241*c* cooperate with the thread pinching surface 241*a* to pinch the currently unused threads 22 therebetween. With this arrangement, the currently unused threads 22 are prevented from moving out of the eyes 207 when the sewing operation starts again after switching of the needle bars 205.

Figure 7:
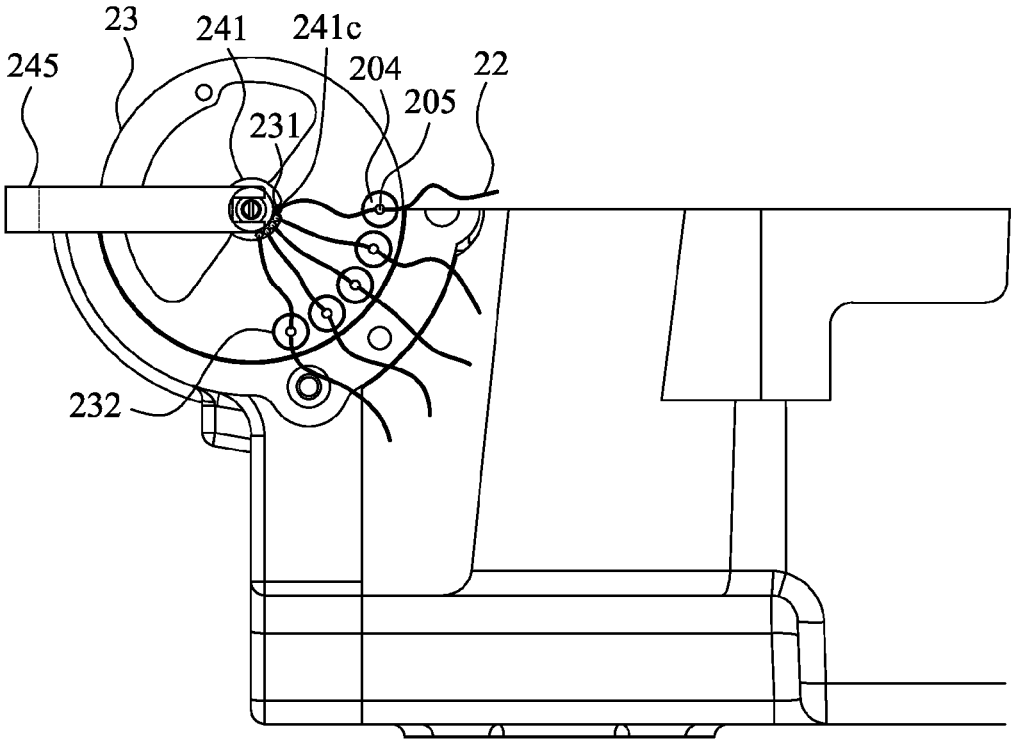
FIG. 7 is a bottom view showing a plurality of threads is downward extended through the locating disc into the eyes of different needles.

Please refer to FIG. 7. When the threads 22 have been respectively routed through the thread course defined by the thread holes 213 on the thread take-up lever 21, the hollow space 203 in the cylindrical needle bar case 20, and the eyes 207 on the needles 206, the sections of the threads 22 located between the thread guide holes 231 and the eyes 207 are radially outward arrayed from top to bottom, so that the threads 22, after extending through the thread holes 213, the thread guide holes 231 and the eyes 207, are substantially equally spaced. With this arrangement, the length of the threads 22 in the thread course can still maintain stable after the needle bars 205 have been switched from one to another on the sewing machine 10.

Figure 8:
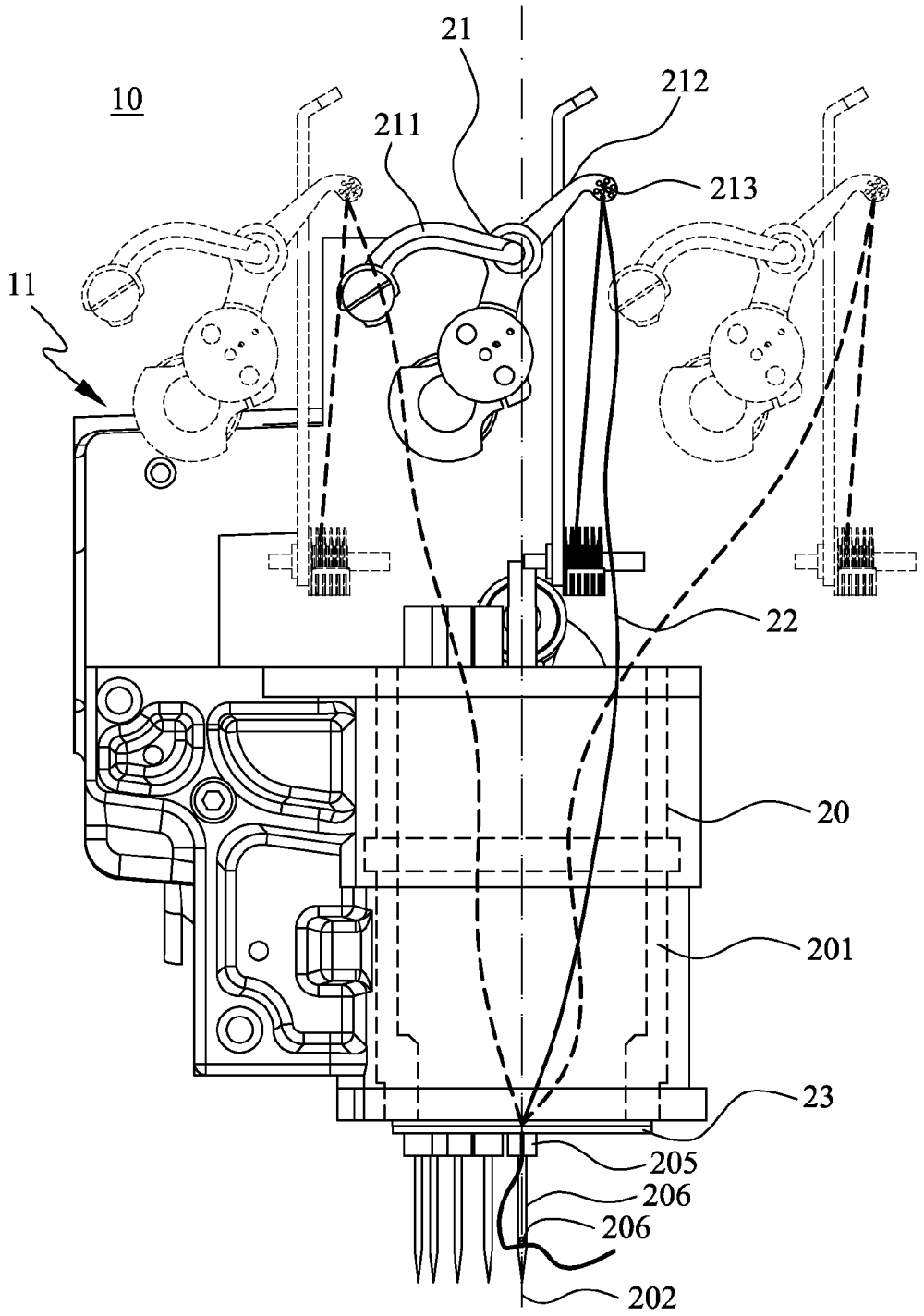
FIG. 8 shows a thread take-up lever included in the thread routing mechanism of the present invention can be connected to different positions on the sewing head of the sewing machine to change its position relative to the cylindrical needle bar case.
Figure 9:
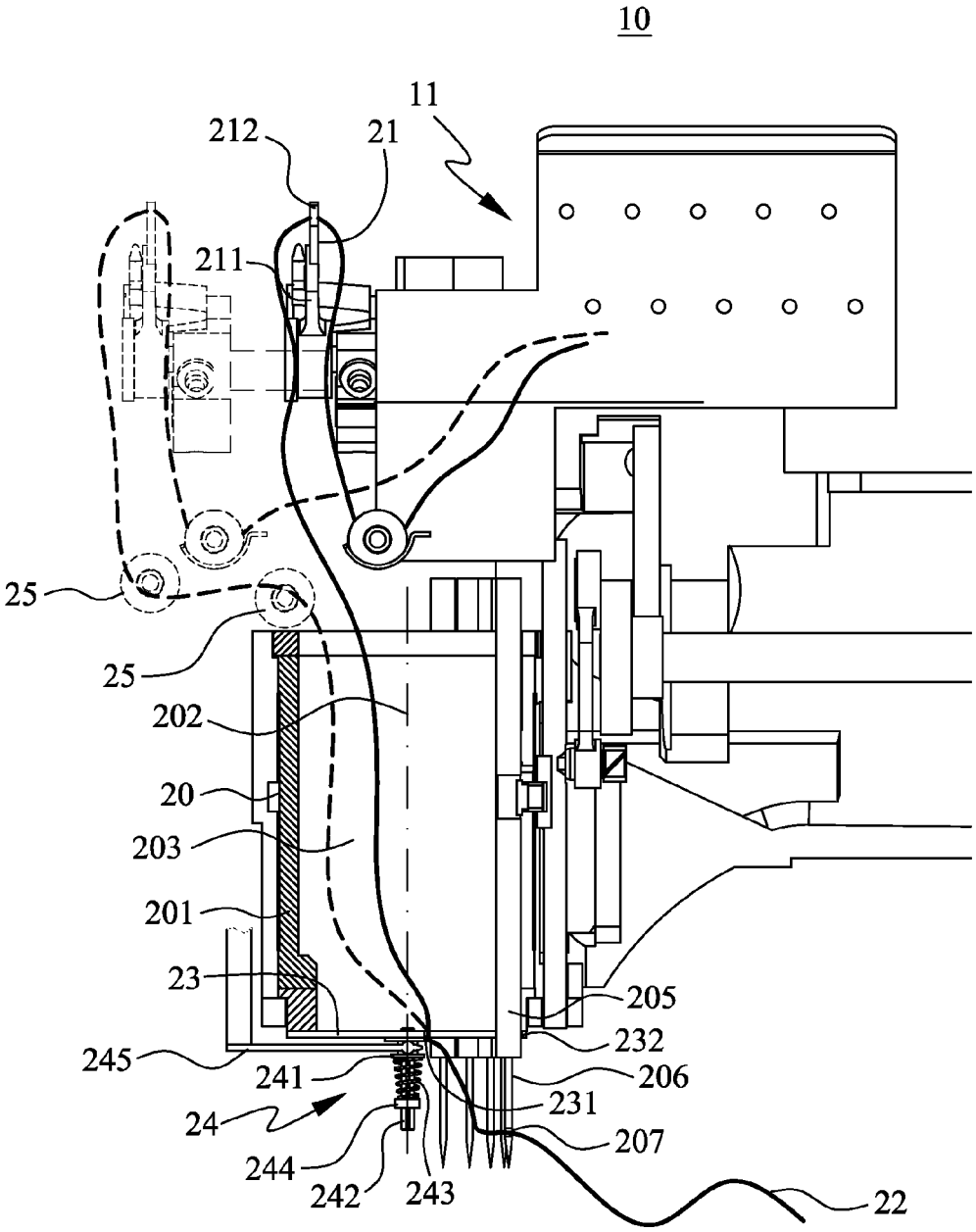
FIG. 9 shows the thread take-up lever can be located at a position above and forward protruded from the cylindrical needle bar case.
Figure 10:
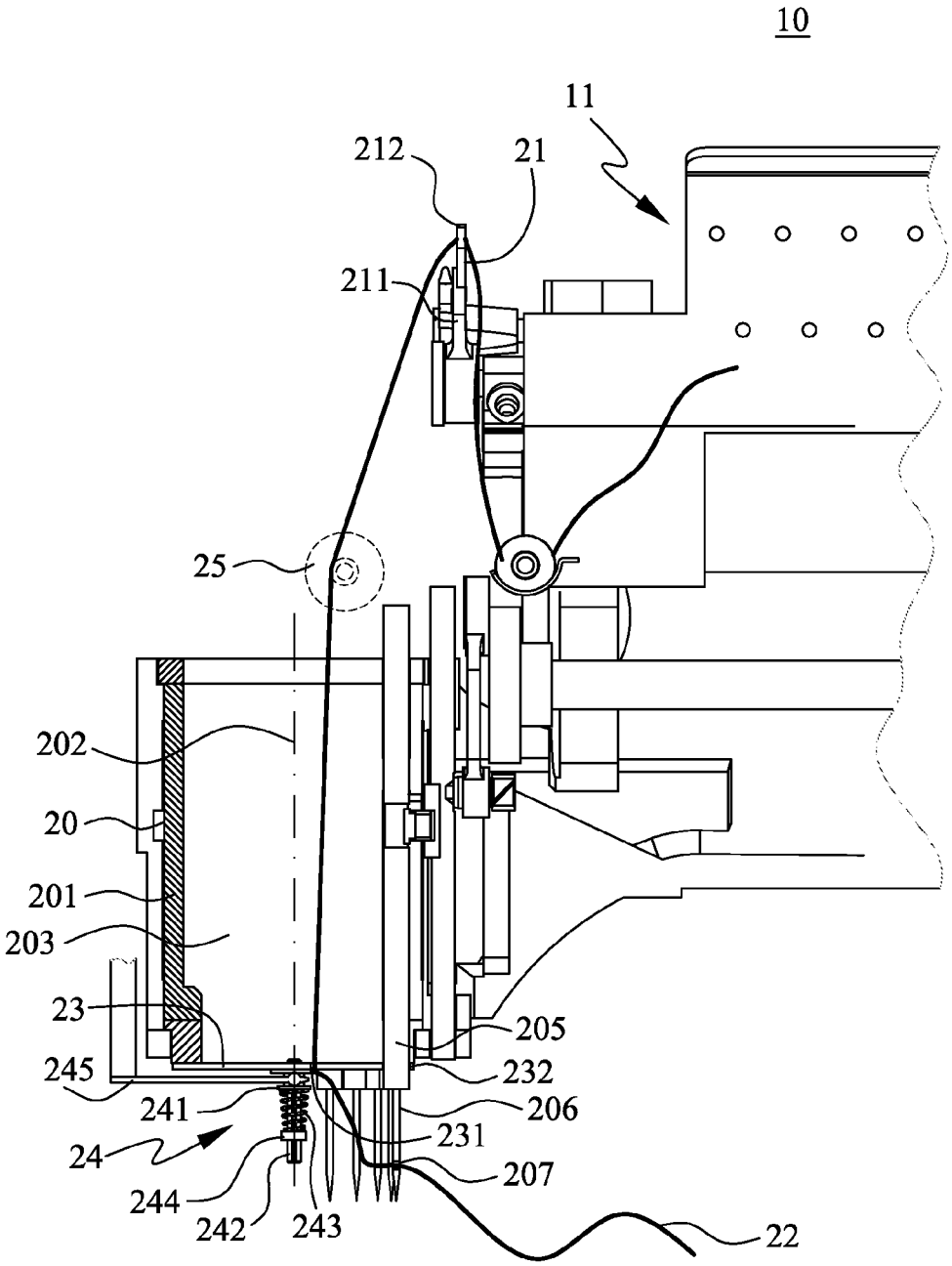
FIG. 10 shows the thread take-up lever can be located at a position above and behind the cylindrical needle bar case.

While the above illustrated embodiment includes a thread take-up lever 21 located immediately above the cylindrical wall 201, it is understood the previous embodiment is only illustrative and not intended to limit the present invention in any way. In practical implementation of the present invention, the thread take-up lever 21 can be connected to different positions on the sewing head 11 of the sewing machine 10 to change its position relative to the cylindrical needle bar case 20. For example, as shown in FIG. 8, the position of the thread take-up lever 21 can be sidewardly shifted to locate outside and higher than the cylindrical wall 201. Alternatively, the thread take-up lever 21 can be mounted to a front end of the sewing head 11 to locate in front of the cylindrical needle bar case 20, as shown in FIG. 9, or to locate behind the cylindrical needle bar case 20, as shown in FIG. 10.

Since the change of the position of the thread take-up lever 21 might prevent the threads 22 in the hollow space 203 from being in a near-vertical state, and the cylindrical wall 201 might interfere with the threads 22 to hinder the thread take-up lever 21 from stably taking up the threads 22, it is necessary to provide one or more thread guides 25 in the thread course between the thread holes 213 on the thread take-up lever 21 and the cylindrical needle bar case 20 for maintaining the threads 22 in tension while changing the route of the threads 22, so that the threads 22 would not contact with the cylindrical wall 201 of the cylindrical needle bar case 20.

Figure 11:
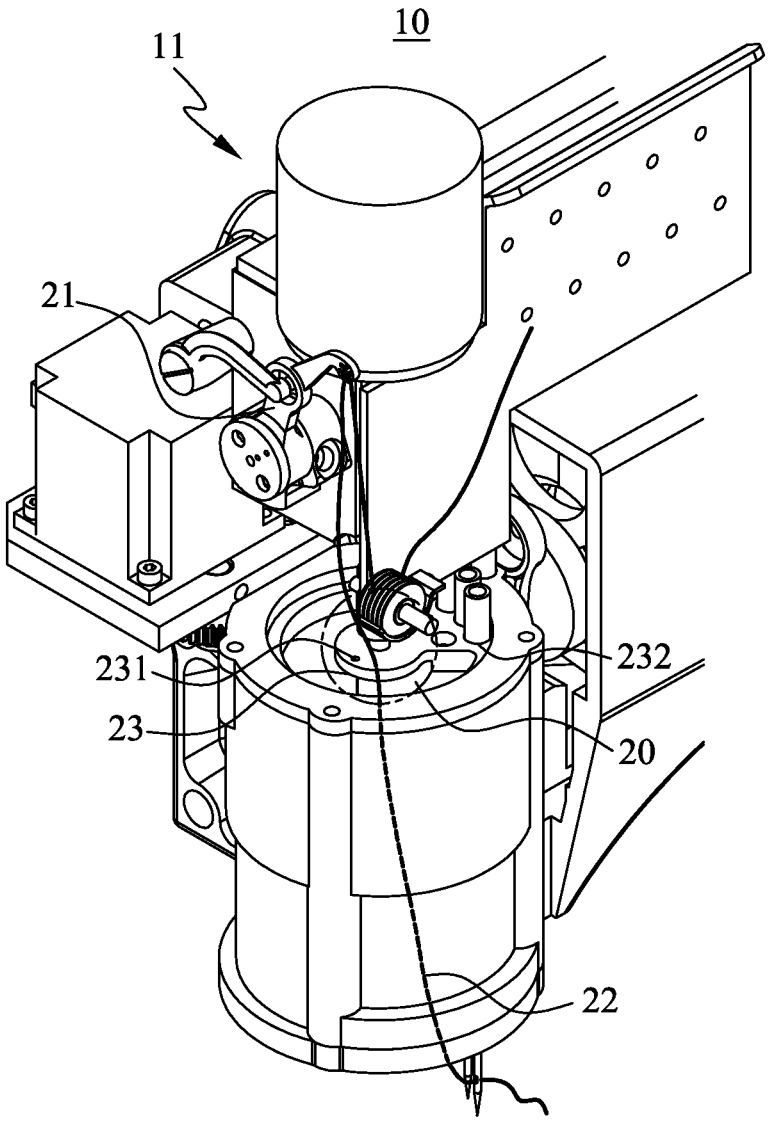
FIG. 11 shows a locating disc is provided on a top of the cylindrical needle bar case.
Figure 11A:
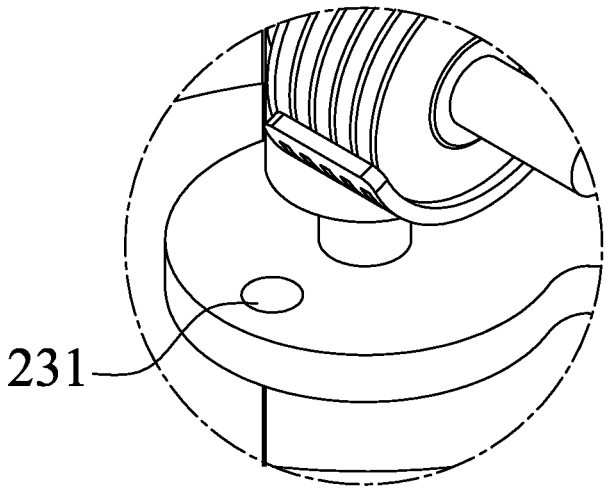
FIGS. 11A and 11B are enlarged views showing the locating disc of FIG. 11 is provided with one single thread guide hole and a plurality of thread guide holes, respectively.
Figure 11B:
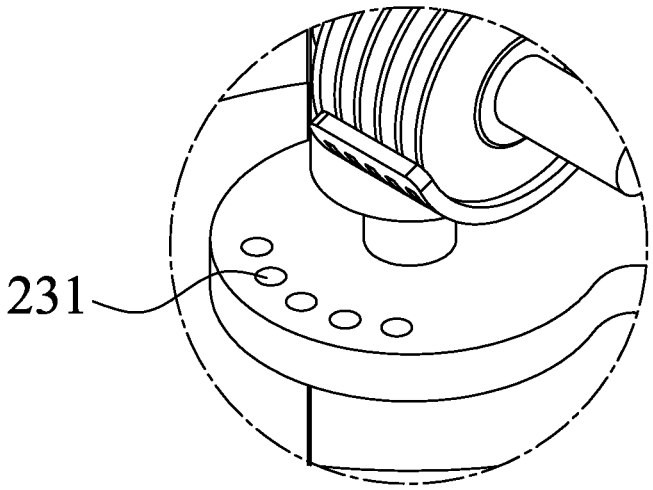

Please refer to FIG. 11. In another preferred embodiment of the present invention, a locating disc 23 is further provided on the top of the cylindrical needle bar case 20 to rotate synchronously with the latter. The locating disc 23 is provided near the rotation axis 202 with a thread guide hole 231, as shown in FIG. 11A; or alternatively, as shown in FIG. 11B, the locating disc 23 can be provided closely around the rotation axis 202 with a plurality of spaced thread guide holes 231, through which the threads 22 are extended to restrict the thread course.

Figure 12:
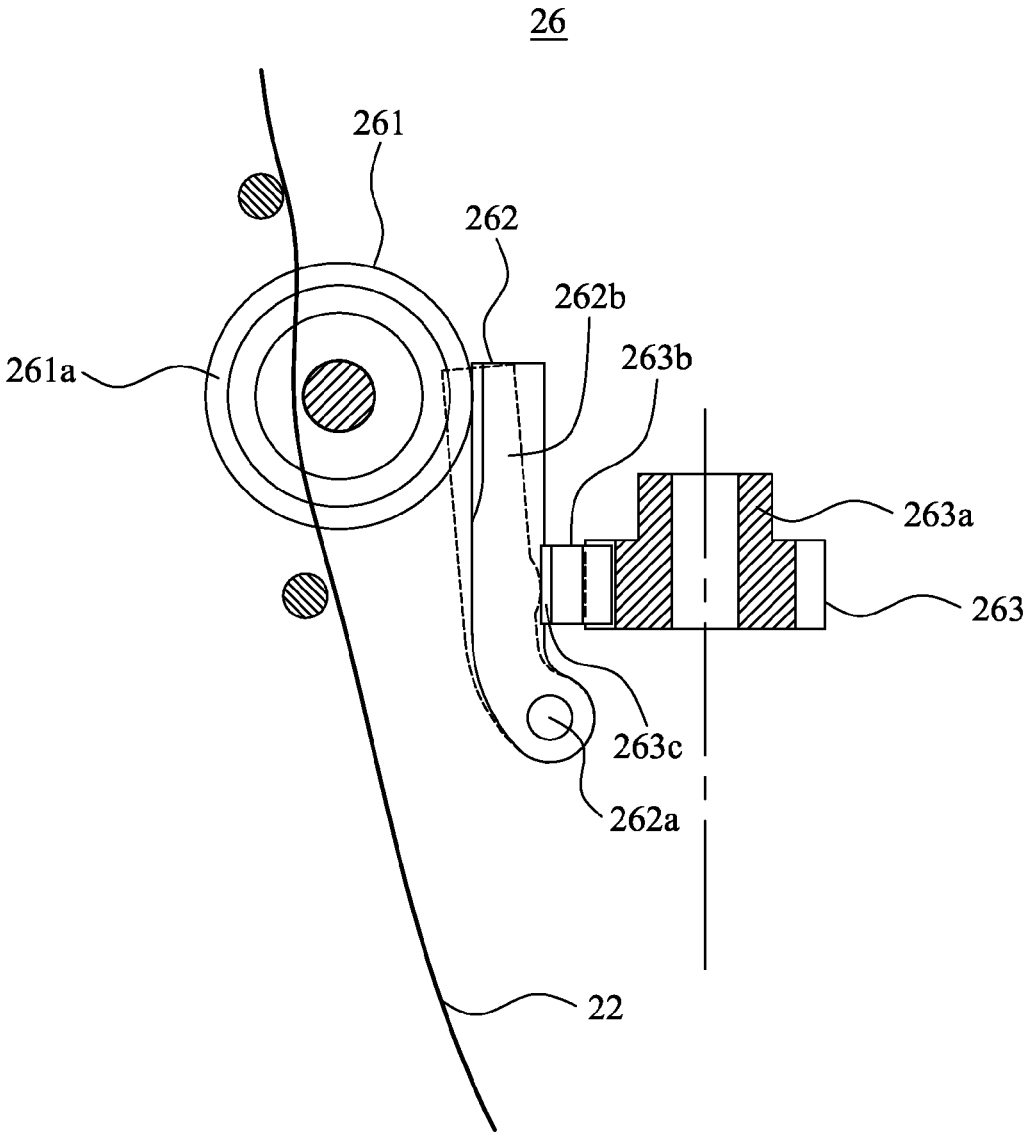
FIG. 12 is a sectional side view showing a first embodiment of a thread pinching mechanism that is provided between the thread take-up lever and the cylindrical needle bar case of the present invention.

A thread pinching mechanism 26 can be provided between the thread take-up lever 21 and the cylindrical needle bar case 20. As shown in FIG. 12, the thread pinching mechanism 26 includes a thread pressing unit 261, a thread releasing unit 262 and a driving unit 263. The thread pressing unit 261 consists of a plurality of parallelly arranged pressing discs 261*a*, between any two adjacent ones of which one thread 22 is extended through. The thread releasing unit 262 is located at one side of the pressing discs 261*a*, and includes a pivot shaft 262*a* and a plurality of parallelly arranged thread releasing plates 262*b*. The thread releasing plates 262*a* are respectively pivotally turnably connected at one end to the pivot shaft 262*a* and are located in a staggered relation with respect to the pressing discs 261*a*. The driving unit 263 is located at one side of the thread releasing unit 262 for pushing one of the thread releasing plates 262*b* into between two adjacent pressing discs 261*a*. In the illustrated embodiment, the driving unit 263 includes a gearwheel 263*a* and a rack-like movable member 263*b*. The gearwheel 263*a* is mounted about the rotation axis 202. The movable member 263*b* has one side formed into a rack for meshing with the gearwheel 263*a*, and another opposite side formed with a protruded rib 263*c*.

Figure 13A:
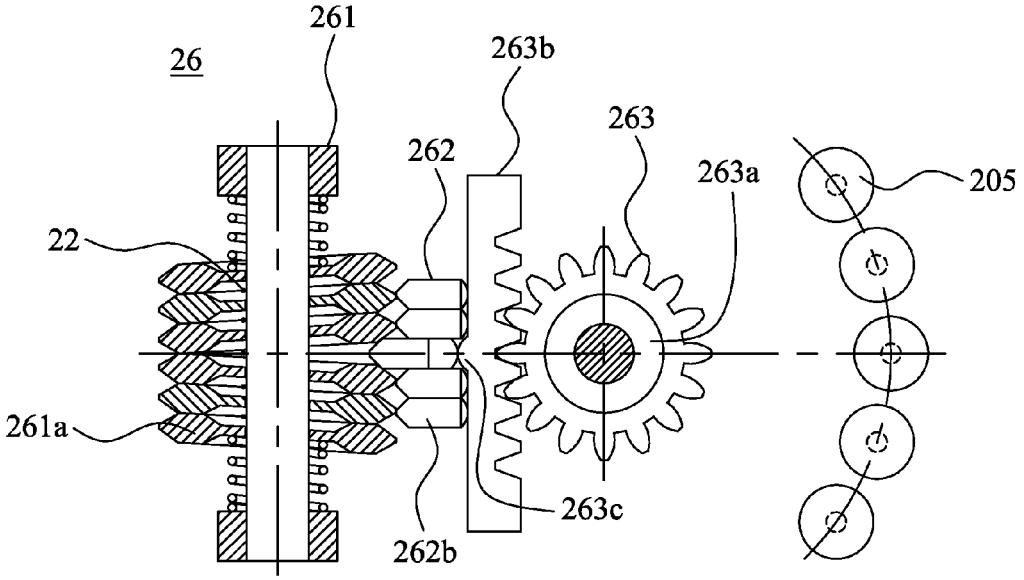
FIGS. 13A and 13B are sectional top views showing how the thread pinching mechanism of FIG. 12 operates in a needle switching operation.
Figure 13B:
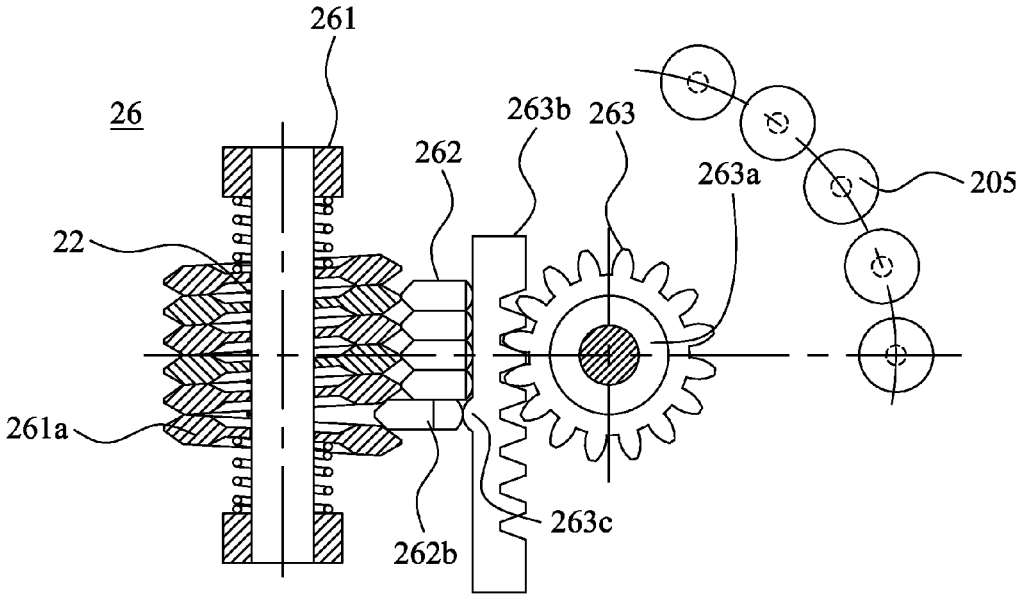

Please refer to FIGS. 13A and 13B. When the sewing machine 10 prepares to switch the needle bars 205 from one to another, the gearwheel 263*a* is rotated about the rotation axis 202 to thereby change the position of the movable member 263*b*. As a result, the protruded rib 263*c* is shifted to align with and push a selected one of the thread releasing plates 262*b* into between another two adjacent pressing discs 261*a*. In this manner, the threads 22 on the needle bars 205 that are not to be used in the next sewing operation are immovably pinched by between the thread pressing discs 261*a*, while the thread 22 on the needle bar 205 for the next sewing operation can be released from the separated thread pressing discs 261*a* and be freely fed for use.

Figure 14:
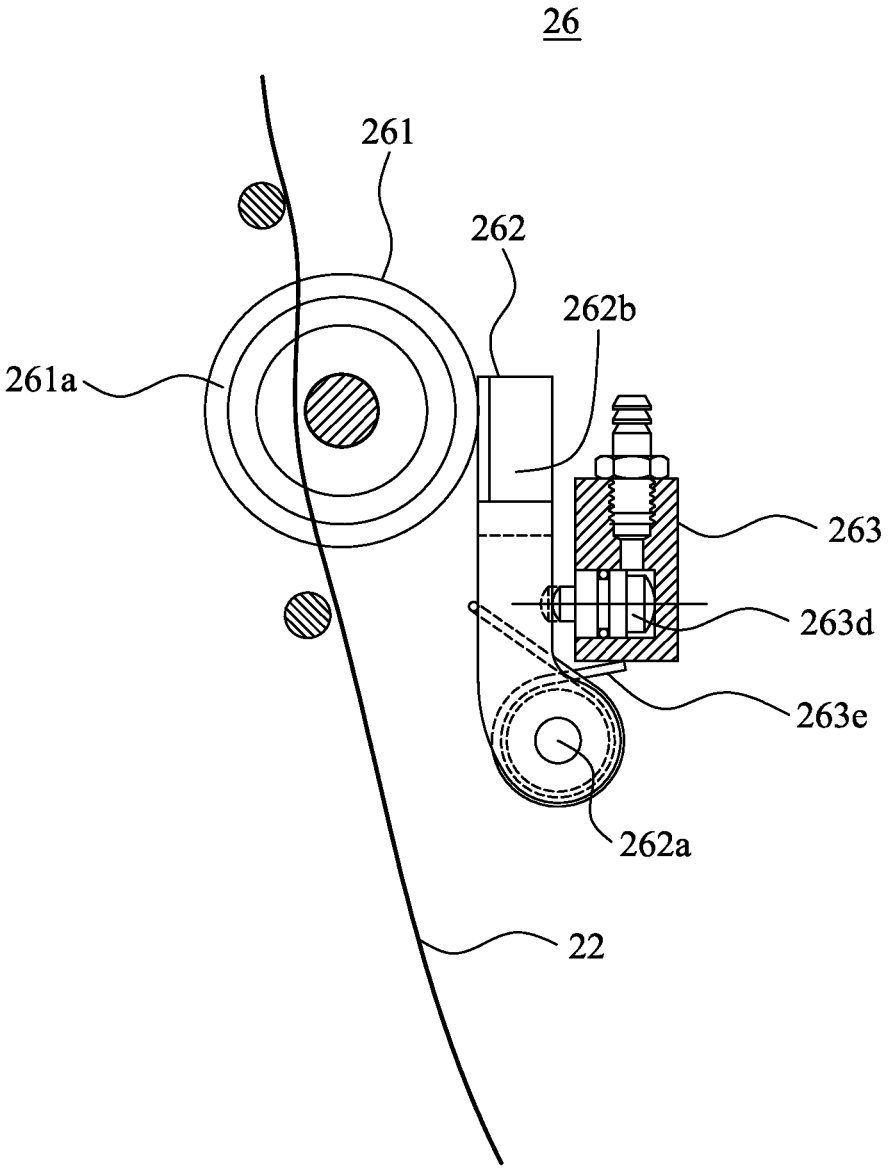
FIG. 14 is a sectional side view showing a second embodiment of thread pinching mechanism that is provided between the thread take-up lever and the cylindrical needle bar case of the present invention.
Figure 15:
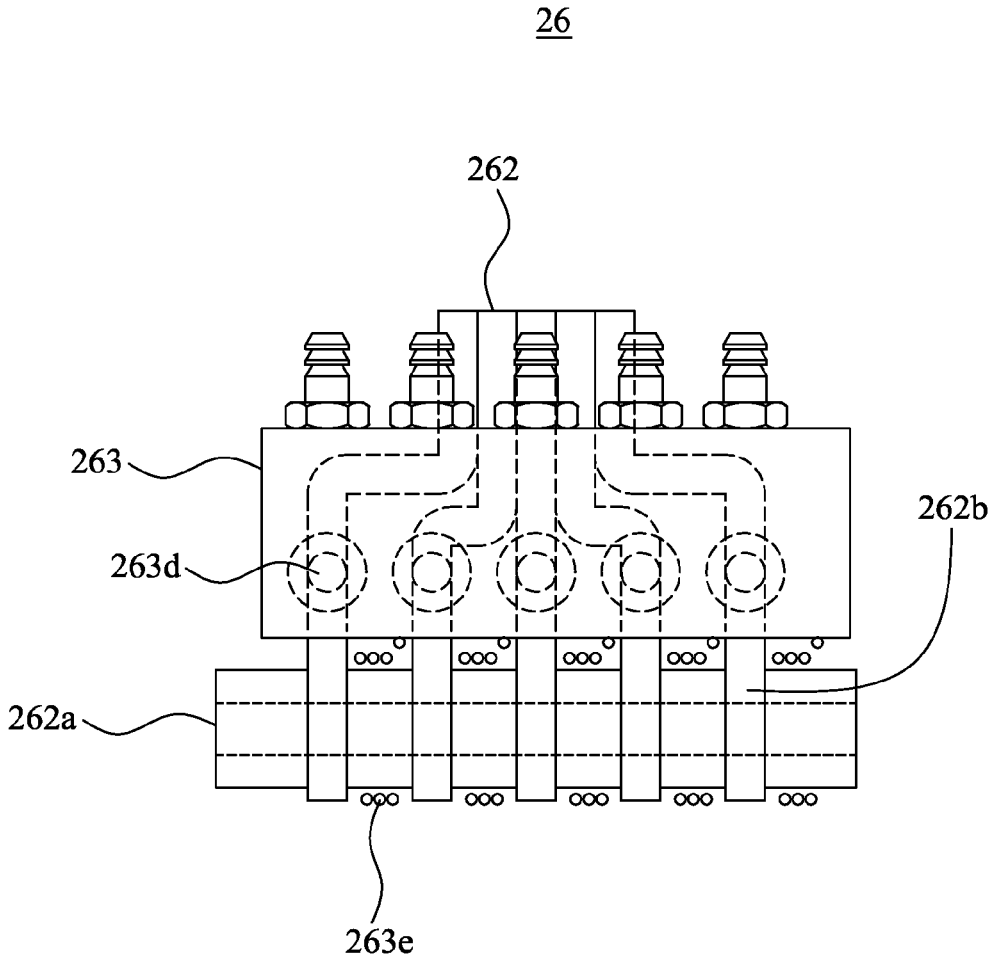
FIG. 15 shows the thread pinching mechanism of FIG. 14 viewed from another angle.

According to another operable embodiment as shown in FIGS. 14 and 15, the driving unit 263 includes a plurality of air cylinders 263*d* for respectively pressing against one thread releasing plate 262*b*. The air cylinders 263*d* are controlled via a set of pressure lines (not shown) to operate synchronously with the needle bar switching mechanism 12 for releasing the thread 22 that is to be used. Meanwhile, a plurality of restoring springs 263*e* is fitted around the pivot shaft 262*a* in one-to-one correspondence with the thread releasing plates 262*b* to restore the non-actuated air cylinders 263*d* to their original positions.

It is understood the driving units 263 in the above two embodiments are only illustrative and not intended to limit the structure of the driving unit 263 in any way. Any other different structural designs that equivalently achieve the function of releasing the selected thread 22 are also included in the technical means of the present invention.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A thread routing mechanism for needle-switchable type sewing machine, comprising:

a thread take-up lever including a sway control end and a thread take-up end; the sway control end bringing the thread take-up end to move upward and downward, and the thread take-up end being provided with a plurality of thread holes;

a cylindrical needle bar case having a rotation axis and a plurality of spaced needle bar holes, and internally defining a hollow space extended from a top to a bottom of the cylindrical needle bar case; the needle bar holes being equally distant from the rotation axis and each having a needle bar received therein; and the needle bars respectively carrying a needle having an eye formed thereon; and a plurality of threads being separately routed through a thread course defined by the thread holes on the thread take-up lever, the hollow space in the cylindrical needle bar case, and the eyes on the needles.

2. The thread routing mechanism for needle-switchable type sewing machine as claimed in claim 1, further comprising a locating disc provided on the bottom of the cylindrical needle bar case; and the locating disc being provided with at least one thread guide hole, through which the threads are extended.

3. The thread routing mechanism for needle-switchable type sewing machine as claimed in claim 2, further comprising a thread pinching unit mounted to an underside of the locating disc.

4. The thread routing mechanism for needle-switchable type sewing machine as claimed in claim 3, wherein the thread pinching unit includes a pinching member mounted to the underside of the locating disc at a position corresponding to the thread guide holes; the pinching member including a thread pinching surface for covering the thread guide holes; and the thread pinching surface being provided on an outer edge thereof with a notch, which is aligned with one of the thread guide holes.

5. The thread routing mechanism for needle-switchable type sewing machine as claimed in claim 4, wherein the thread pinching unit further includes a shaft member, a spring and a nut, which work with the pinching member to together form a means of pinching the threads.

6. The thread routing mechanism for needle-switchable type sewing machine as claimed in claim 5, wherein the thread pinching unit further includes a driving lever, which works with the pinching member to together form a means of releasing the threads.

7. The thread routing mechanism for needle-switchable type sewing machine as claimed in claim 1, further comprising a locating disc mounted to the top of the cylindrical needle bar case to rotate synchronously with the cylindrical needle bar case; and the locating disc being provided at positions around the rotation axis with at least one thread guide hole, through which the threads are extended.

8. The thread routing mechanism for needle-switchable type sewing machine as claimed in claim 1, further comprising a thread pinching mechanism provided between the thread take-up lever and the cylindrical needle bar case.

9. The thread routing mechanism for needle-switchable type sewing machine as claimed in claim 8, wherein the thread pinching mechanism includes a thread pressing disc unit consisting of a plurality of parallelly arranged pressing discs, a thread releasing unit located at one side of the pressing discs, and a driving unit for pushing the thread releasing unit to move; the thread releasing unit including a pivot shaft and a plurality of parallelly arranged thread releasing plates; the thread releasing plates being respectively pivotally turnably connected at one end to the pivot shaft and being located in a staggered relation with respect to the pressing discs; and the driving unit pushing a selected one of the thread releasing plates into a position between two adjacent pressing discs.

10. The thread routing mechanism for needle-switchable type sewing machine as claimed in claim 1, further comprising at least one thread guide located in the thread course between the thread holes on the thread take-up lever and the hollow space in the cylindrical needle bar case for maintaining the threads in tension while changing the course of the threads.

* * * * *